US007487567B2

(12) United States Patent
Kresse et al.

(10) Patent No.: US 7,487,567 B2
(45) Date of Patent: Feb. 10, 2009

(54) FLAT MOP COVER FOR A MOPPING DEVICE, IN PARTICULAR FOR FLOOR CLEANING

(75) Inventors: Franz Kresse, Hilden (DE); Ulrich Kröcker, Remscheid (DE)

(73) Assignee: Ecolab, Inc., Saint Paul, MN (US)

( * ) Notice: Subject to any disclaimer, the term of this patent is extended or adjusted under 35 U.S.C. 154(b) by 0 days.

(21) Appl. No.: 10/566,910

(22) PCT Filed: Jun. 29, 2004

(86) PCT No.: PCT/EP2004/007014

§ 371 (c)(1),
(2), (4) Date: Jun. 1, 2006

(87) PCT Pub. No.: WO2005/013793

PCT Pub. Date: Feb. 17, 2005

(65) Prior Publication Data

US 2007/0061987 A1 Mar. 22, 2007

(30) Foreign Application Priority Data

Aug. 7, 2003 (DE) ..... 103 36 173

(51) Int. Cl.
*A47L 13/20* (2006.01)

(52) U.S. Cl. ..... 15/228; 15/229.4; 15/229.8

(58) Field of Classification Search ..... 15/228, 15/229.4, 229.8, 229.1, 229.2, 229.3, 229.5, 15/229.6, 229.7, 229.9
See application file for complete search history.

(56) References Cited

U.S. PATENT DOCUMENTS 5,680,667 A 10/1997 Kresse
5,864,914 A * 2/1999 Salmon ..... 15/147.2
5,887,311 A 3/1999 Kresse
6,017,163 A 1/2000 Keppers
6,233,777 B1 5/2001 Kresse
6,258,455 B1 7/2001 Clarke
6,968,591 B2 * 11/2005 Tanaka ..... 15/229.1

FOREIGN PATENT DOCUMENTS

| | | |
|---|---|---|
| EP | 1212972 | 6/2002 |
| JP | 11146857 | 6/1999 |
| WO | WO99/62393 | 12/1999 |
| WO | WO02/084002 | 10/2002 |
| WO | WO2005/013792 | 2/2005 |
| WO | WO2005/039376 | 5/2005 |
| WO | WO2006/002652 | 1/2006 |
| WO | WO2006/002653 | 1/2006 |
| WO | WO2006/002654 | 1/2006 |
| WO | WO2006/002655 | 1/2006 |

* cited by examiner

*Primary Examiner*—Randall Chin
(74) *Attorney, Agent, or Firm*—Fredrikson & Byron, P.A.

(57) ABSTRACT

The invention relates to a flat mop cover for a flat mopping device, comprising a large area backing textile (1) having longitudinal edges and transversal edges and having a mopping side (4), which is active in cleaning, and a top side (7), which is used to attach the mop cover to a mop holder (5) of a mopping device (6), wherein insertion pockets, holding strips or other attachment means (13) for the mop holder (5) are provided on the top side (7) of the backing textile (1). This mop cover is particularly efficient in floor cleaning, because the backing textile (1) is a knitted fabric, preferably of polyester micro-fiber material.

18 Claims, 7 Drawing Sheets

FLAT MOP COVER FOR A MOPPING DEVICE, IN PARTICULAR FOR FLOOR CLEANING

The present invention relates to a flat mop cover for a mopping device, which is, in particular, suitable for floor cleaning, as well as to the use of such mop cover.

Mopping devices for mopping surfaces to be cleaned are widely known and in extensive use in professional and non-professional floor cleaning. They use a mop holder with a removably attached flat mop cover from textile material made from natural or synthetic fibers including and increasingly using micro-fibers. The present invention deals with flat mop covers for use with mopping devices.

Flat mop covers, as well, are widely known for use in mopping devices for mopping surfaces to be cleaned. A typical flat mop cover has a flat backing textile made of cotton, polyester, or polyamide, onto which loops and/or fringes are attached as a trimming. Insofar, reference is made to a prior art of U.S. Pat. No. 5,887,311 A, which extensively explains the materials used, including micro-fibers for trimmings or the like.

Trimmings attached to the backing textile on the mopping side thereof are usually made in the form of loops, strands, tufts, or strips, which is extensively explained in U.S. Pat. No. 5,887,311 A, to which reference is made here as supplemental disclosure.

Liquid absorption of a flat mop cover sometimes is increased by absorbent linings (WO 01/39653 A1).

Cleaning of vertically oriented baseboards or the like is improved by the use of a backing textile that extends, at least toward the longitudinal edges thereof, past the edges defined by the outer contour of the mop holder to form a relatively broad edge strip on each longitudinal side of the mop cover (DE 31 39 245 C2). Those broad edge strips may be easily folded and may glide without problems, so that vertical surfaces like baseboards can be cleaned by just sweeping past with the mopping device.

The prior art forming the starting point of the invention (U.S. Pat. No. 5,887,311 A) extensively discusses the specifics of professional cleaning of buildings, floors, etc. Here, the characteristics of different materials and fibers for a mop cover are discussed at length considering abrasive effect, soil retention capacity, water retention capacity, gliding behavior, fluff production and, very important, washing and pressing characteristics.

It has, as well, already been proposed to use a flat mop cover with two active layers of different properties forming corresponding cleaning surfaces positioned laterally next to each other and connected at a lengthwise extending, separating line (DE 94 02 509 U1). In this prior art, the mopping side of the flat mop cover has the separating line in the middle with the attachment means for attaching the mop holder being, as usual, on the top side of the backing textile. This prior art proposes that the cleaning surfaces next to each other should have different properties. This means, it should be possible with one mop cover to have a one-mopping tour, first scouring or scrubbing of the floor with a relatively rough material and then cleaning with a relatively soft material, which means soil retention with the relatively soft material. An alternative could be to simultaneously use a wet active layer and the dry active layer next to it immediately thereafter.

The attachment means for the mop holder are usually positioned near the transversal edges of the mop cover, but may be placed along the longitudinal edges thereof, as well. The attachment means are described as insertion pockets or holding strips. Velcro means (burr means) or other attachment means, such as clamping means, can be used, as well, and are known from the prior art (U.S. Pat. No. 5,887,311 U1; DE 94 02 509 U1; WO 03/020100 A1).

Finally, three-dimensional mop holders can be used with flat mop covers, too, which may then form two alternately usable mopping sides (U.S. Pat. No. 5,864,914 A).

There is prior art available (DE 295 20 193 U1) showing a flat mop cover with three layers of textile material, namely two active layers positioned on top of each other and forming opposite, alternately usable cleaning surfaces of about the same size, and a textile separating layer between the two active layers as a backing material in between.

All flat mop covers known from prior art up to now have a woven fabric as a backing textile. This is true for natural and synthetic fibers as well as for all kinds of micro-fibers.

Further, apart from three-dimensional mop holders with mop covers for both alternately usable cleaning surfaces, an increase of the total surface available for mopping and cleaning was never considered in the prior art.

The object of the present invention is to further improve flat mop covers in view of the requirements of professional cleaning.

The above-mentioned object of the present invention is at first met with a flat mop cover of the present invention as described herein, Preferred embodiments of this inventive flat mop cover are described herein.

Further, the above-mentioned object of the present invention is also met with a flat mop cover as described herein. Preferred embodiments of this version of the inventive flat mop cover are also described herein.

The use of mop covers according to the invention for floor cleaning is described herein.

Although the prior art mentioned above (U.S. Pat. No. 5,887,311 A and referenced therein DE 93 01 615 U) extensively discusses a micro-fiber cloth for use in a mop cover, this micro-fiber cloth, as all other backing textiles, is described in this prior art as a woven fabric. However, extensive tests of the applicant have provided the insight that a knitted fabric for the backing textile brings about advantages for the construction of the mop cover as a whole. A knitted fabric has as a further advantage that the edges of the knitted fabric do not need to be hemmed. Further, fibers are lost from the trimmings with a woven fabric as backing textile, whereas this happens much less if a knitted fabric is used.

In the present mop cover, it is possible and preferable that the backing textile, at least on the mopping side, is provided with a trimming of natural or, preferably, synthetic fibers. In particular, the trimming is of loop-forming material such as terrycloth or of cut, densely positioned fibers such as velvet. A trimming of densely positioned fibers or of densely positioned loop-like material is particularly convenient to manufacture with a knitted fabric as backing textile. This is particularly true if the backing textile as a whole, or at least a trimming of the backing textile, is made of micro-fiber material. Polyester is a particularly convenient fiber material, especially for micro-fibers.

According to a preferred embodiment of the invention, the synthetic micro-fiber material, particularly a polyester micro-fiber material, predominantly has micro-fibers of approximately 0.5 to approximately 1.0 dtex. A peripheral micro-fiber trimming improves high cleaning performance (see also U.S. Pat. No. 5,887,311 A for reference).

Further, it is particularly convenient if the backing textile and the insertion pockets or holding strips are made of the same material, preferably of polyester material. This is particularly convenient for polyester material. The shrinking characteristics of both materials are identical here, so that no unnecessary stress results. Polyester material has a shrinkage of only approximately 1% after a large number of washing cycles at 60° C.

Even if the insertion pockets and backing textiles are manufactured from the same material, they can be different parts that are sewn together. As an alternative, however, it may be provided that the insertion pockets are implemented by folding over and sewing initially projecting edge strips of the backing textile.

A rather thin and flexible mop cover may encounter problems when attached to a mop holder during high-speed professional floor cleaning. In order to increase the positioning stability of the mop cover on the mop holder, it may be helpful to provide that the backing textile on its top side is provided with a hem or is formed into a hem approximately where the longitudinal edges of a mop holder rest on the backing textile when such mop holder is in place on the mop cover.

However, as already explained above, it may also be helpful to use insertion pockets or holding strips on the longitudinal edges of the mop cover instead of the transversal edges and using a mop holder with a longitudinally-extending folding axis instead of the usual transversal folding axis.

At present, the mop cover according to the invention has been described with the attachment means on top of the backing textile. Nevertheless, it is a possible option that an additional backing layer is positioned on the top side of the backing textile and fixedly attached thereto, and carries the attachment means for the mop holder.

The gliding resistance of micro-fiber terrycloth or the like, in particular of polyester micro-fibers, is rather high. In order to reduce the gliding resistance, it may be an option to provide that the backing textile on its mopping side is provided with at least one gliding assistance strip running essentially parallel to the longitudinal edges of the mop cover, the gliding assistance strip preferably being positioned approximately in the middle of the mopping side and being made from an easily gliding textile material like polyester felt.

According to a further alternative of the present invention, the cleaning efficiency of the flat mop cover according to the invention may be considerably improved in that a second flat mop cover with a backing textile with a mopping side and a top side, but without attachment means for a mop holder, is provided laterally next to the first flat mop cover at one of its longitudinal edges, the backing textiles of both mop covers are separate parts, but fixedly connected to each other, or are formed as a unitary enlarged backing textile.

Different from the prior art with two active layers of different properties forming corresponding cleaning surfaces, but being positioned both below the mop holder (DE 94 02 509 U1), this modification of a flat mop cover increases the overall size of the mopping side to about the twice the usual size. One part of such mop cover below the mop holder is used with pressure and may be, e.g. used for removing soil from the floor, whereas the second flat mop cover attached to the longitudinal edge of the first mop cover is efficient to retain the detached soil, in particular, if this part is used on a wet surface.

For wet mopping, the enlarged mopping surface is helpful for an even distribution of the cleaning liquid on the floor. The size of a floor part that may be cleaned with one flat mop cover, for example in hospital cleaning, where a flat mop cover may be used only once and must be washed afterwards, is substantially increased with the inventive flat mop cover.

A further improvement may be achieved in that a further active layer forming a third mopping side is positioned on the top side of the backing textile of the second mop cover. A third mopping side is provided, which may be used alternately with the second mopping side by folding the second flat mop cover below the first flat mop cover attached to the mop holder.

In a parallel, co-pending PCT application of the same applicant, namely PCT/EP2004/07014, a further improvement of such kind of multi-surface mop cover is described using a liquid-impermeable or otherwise not liquid transporting separating section between two mopping sides. Reference is made to the full content of this parallel patent application as a supplemental disclosure.

It may be interesting that the separating section is a separating strip between the backing textiles. Insofar, it is possible that the separating section is of the same material as the backing textiles of the neighboring mop covers and is unitarily formed therewith. An alternative solution is that the separating section is a separate part, but connected to the neighboring backing textiles and, preferably, is from a different material than the material of the neighboring backing textiles. In particular, with the last-mentioned design, it is possible that a separating section is provided as a liquid-impermeable separating layer between the active layer and the backing textile of the second mop cover.

For an asymmetrical one-layer/two-layer combination with the attachment means positioned on top on the one-layer section, it is an interesting option that in the two-layer section a separating section is provided as a liquid-impermeable separating layer between the active layer and the backing textile of the second mop cover.

Finally, a separating strip between two layers next to each other gives a further option for a specific design. It may be provided that the separating section is made from or specifically constructed as a section of abrasive material.

Finally, the use of a flat mop cover according to the invention for floor cleaning is of particular interest, in particular for professional floor cleaning in large buildings, hospitals or the like.

Now, further features, advantages and applications of the invention can be obtained from the following detailed description of preferred embodiments of the invention taken in conjunction with the accompanying drawings. In the drawings FIG. 1 shows a flat mop cover on a mop holder in a top view, FIG. 2 shows the mop cover of FIG. 1 by itself, seen from the top, FIG. 3 shows the mop cover of FIG. 2, seen from the bottom, FIG. 4 shows a mop cover in an illustration corresponding to FIG. 1, FIG. 5 shows the mop cover of FIG. 4 in an illustration similar to FIG. 2, FIG. 6 shows the mop cover of FIG. 4 in an illustration similar to FIG. 3.

Figure 1:
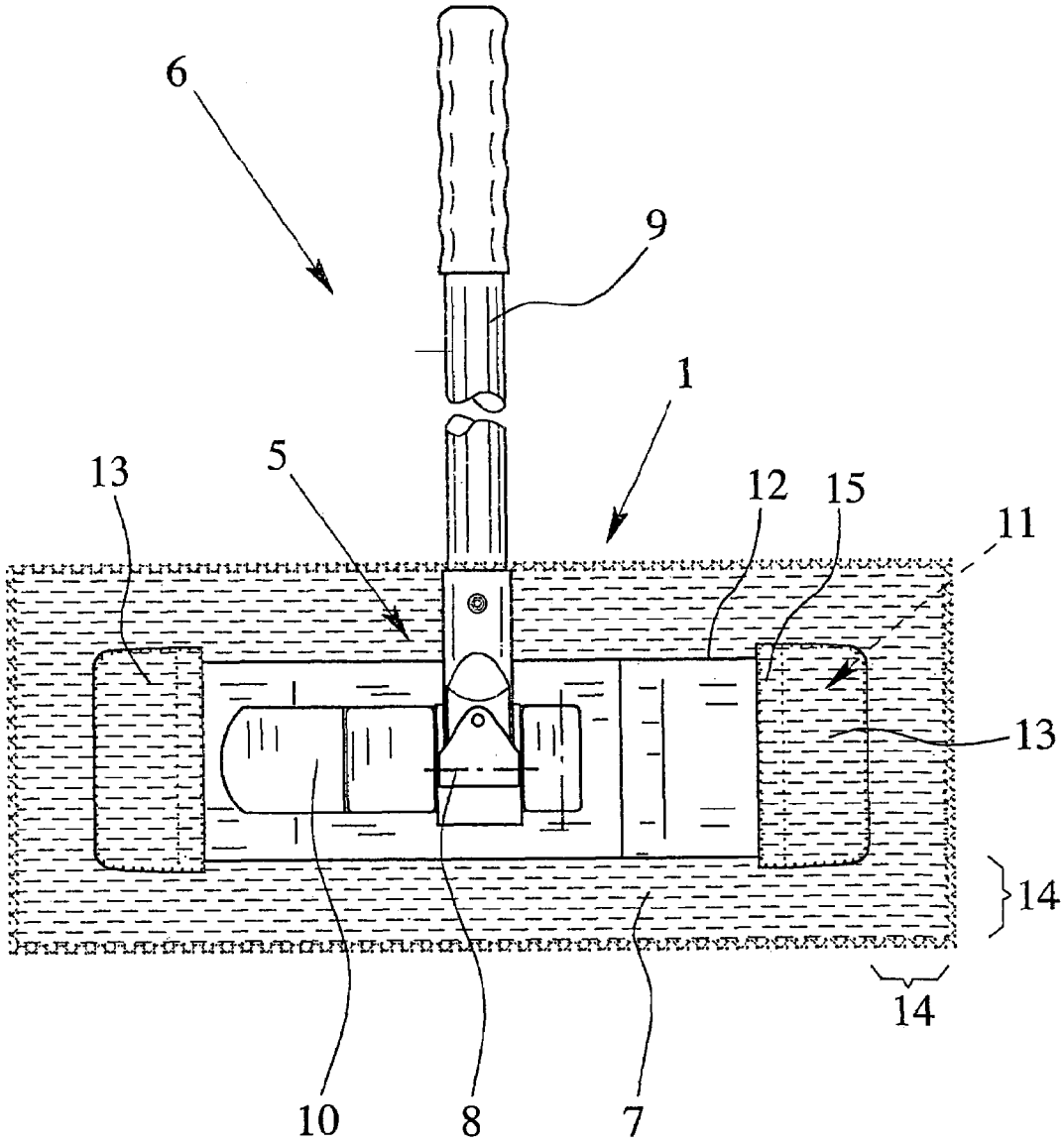
Figure 2:
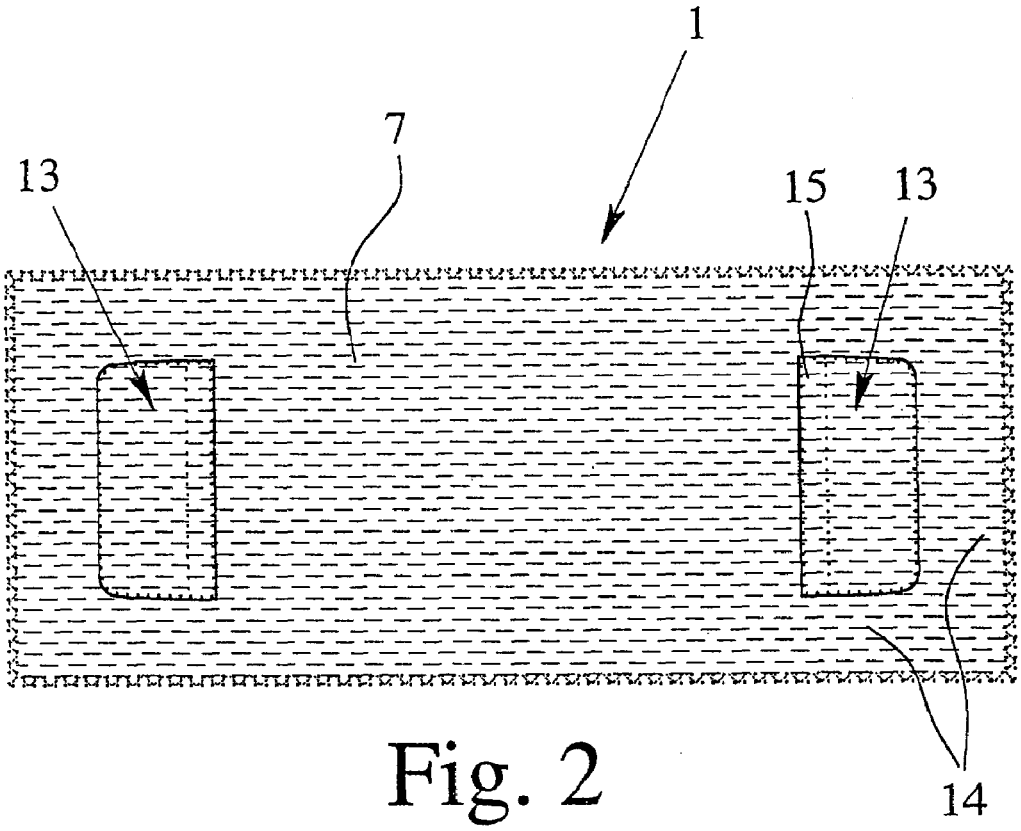
Figure 3:
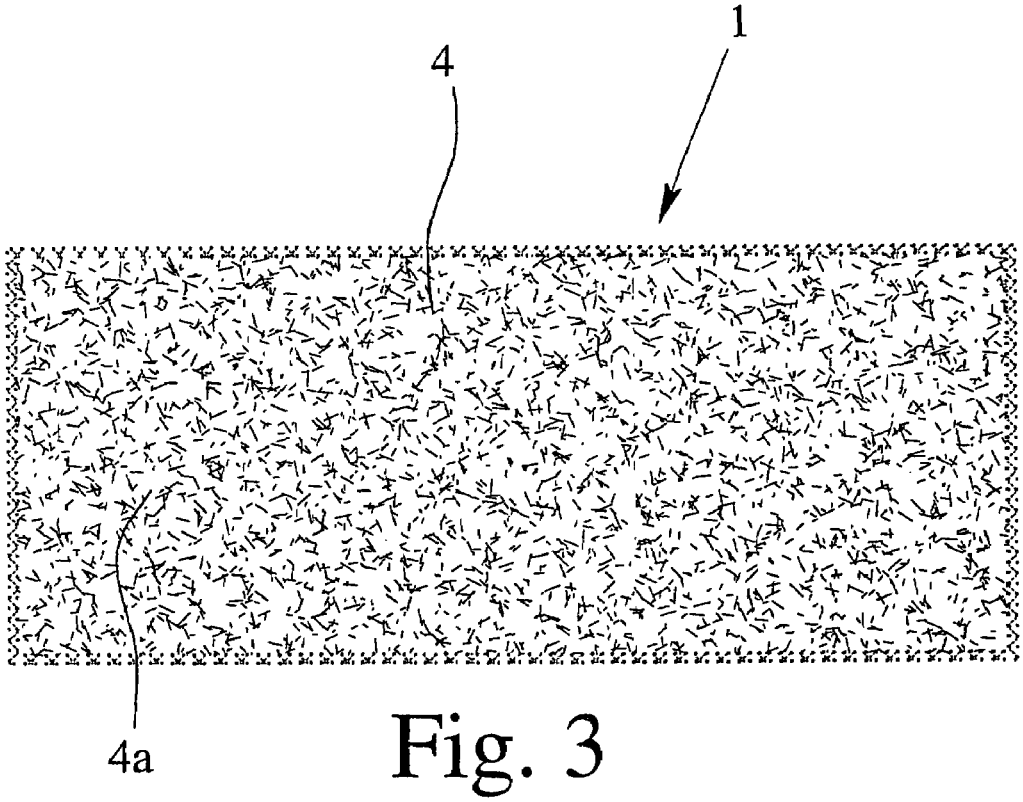

The flat mop cover shown in FIG. 1 is intended for a flat mop holder and is shown on such a mop holder in FIG. 1. FIG. 2 and FIG. 3 are also to be used to understand FIG. 1. The mop cover primarily shows a large area of backing textile 1 having longitudinal edges, as well as a mopping side 4, which is active in cleaning, shown in FIG. 3, and a top side 7, visible in FIG. 1 and FIG. 2, used to attach the mop cover onto, for example, a plate-like mop holder 5 of a mopping device 6. The mopping device 6 has a cardan joint 8, positioned on the mop holder 5, which is implemented as a plate here, to which a handle 9 of the mopping device 6 having the mop holder 5 is connected. The cardan joint 8 allows movements of the mop holder 5 in relation to the handle 9 in nearly all directions.

In addition to the cardan joint 8, an opening mechanism 10 may be seen on the mop holder 5, by which the mop holder 5 may be folded together in order to be thus detached from the backing textile 1.

The mop holder 5, implemented here as a plate, has ends 11 and longitudinal sides 12, the ends 11 being inserted into attachment means 13, here provided as insertion pockets 13, which are positioned on the top side 7 of the backing textile 1. In this way, the mop cover is held on the mop holder 5. It is correspondingly true here that even for a mop holder 5 whose width is reduced at the end, a corresponding application of the teaching of the present patent application is possible. In addition, this teaching is also correspondingly applicable for attachment means 13 other than insertion pockets, i.e., for holding strips, attachment bows, Velcro means or the like.

The insertion pockets 13 define edges on the top side 7 of the backing textile 1 by their outer contour. FIG. 1 and FIG. 2 together show that, in this case, the backing textile 1 extends beyond the edges defined by the insertion pockets 13 and forms an edge strip 14 on each side. This is also true for the ends of the backing textile 1 in the exemplary embodiment. The implementation of this edge strip 14, which is flush with the surface to be cleaned and does not curve upward, has some advantages in regard to cleaning work. If the mop holder 5 is stepped at the ends, this also correspondingly applies for the edges defined on the backing textile 1 by the width of the mop holder 5, because they form the outer contour.

The exemplary embodiment provides that the edge strips 14 may have a width of at least 2 cm, preferably at least 4 cm, particularly approximately 5 to 6 cm.

It was already noted above that it is especially expedient if the backing textile 1 and the insertion pockets 13 are made of the same material. The same material avoids differing shrinkage. The use of the same material is especially expedient if it is a polyester material.

The exemplary embodiment shown in FIGS. 1 to 3 shows that in this case the insertion pockets 13 are sewn onto the backing textile 1. The insertion pockets 13 are therefore each sewn on three sides and have a fold 15 on the entrance side for the end 11 of the mop holder 5, which ensures the end 11 of the mop holder 5 may be inserted easily.

Figure 4:
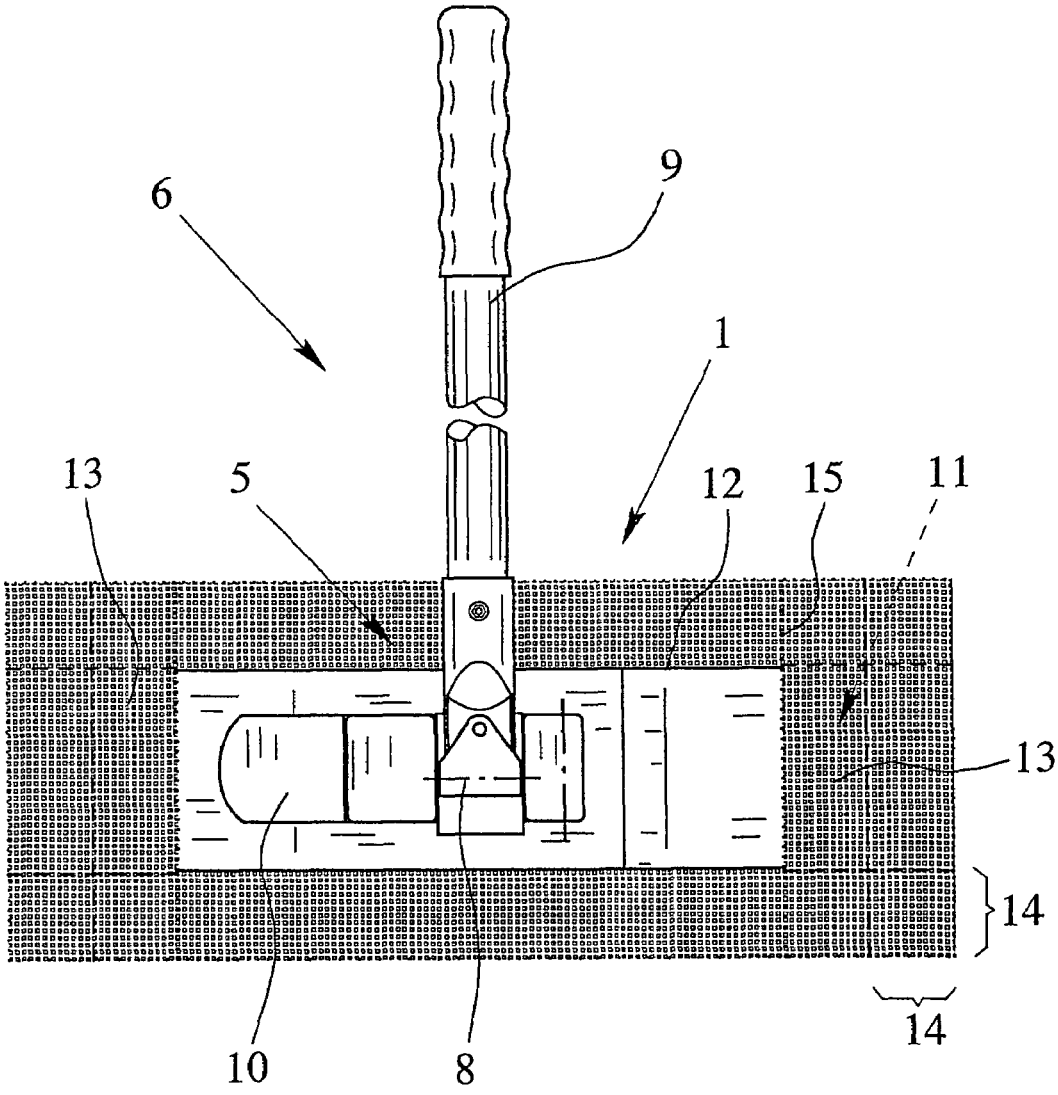
Figure 5:
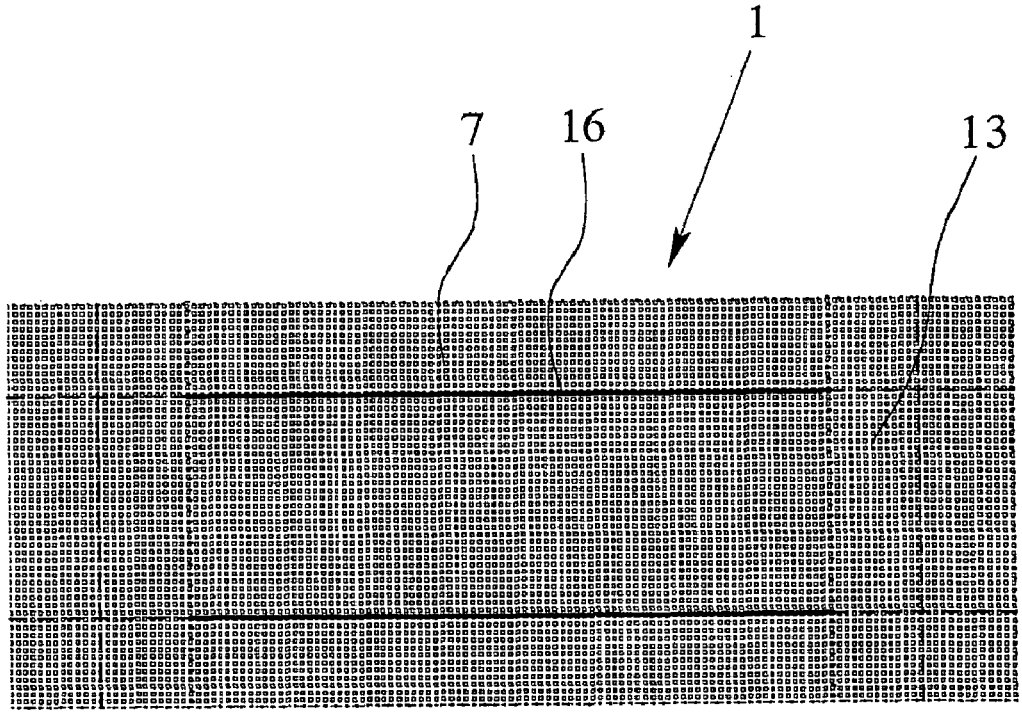
Figure 6:
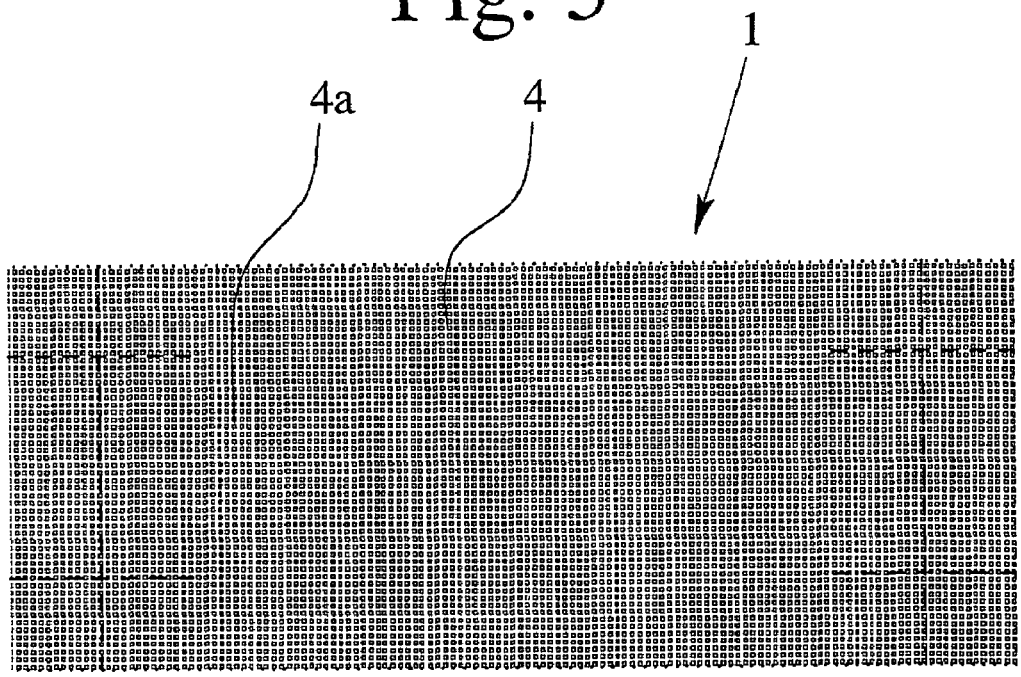

The other exemplary embodiment illustrated in FIGS. 4 to 6, in contrast, shows that in this case the insertion pockets 13 are implemented by folding over and sewing initially projecting edge strips of the backing textile 1. FIG. 5 shows the outline of a modification on the top side 7 of the backing textile 1. In this case, a hem 16, which runs along the edge of the mop holder 5 (not shown here), is implemented by appropriate sewing.

In FIG. 5, the view from the top side 7 is shown, and in FIG. 6, the view from the mopping side 4, which is active in cleaning, is shown. The seams running through the backing textile 1 may be seen here. In this embodiment, the insertion pockets 13 and the backing textile 1 are made of the same material. This is particularly polyester material here as well, which may then expediently also be sewn using polyester thread, which results in uniform shrinkage.

The embodiment shown in FIGS. 1 to 3 shows a textile fabric whose edges are hemmed or otherwise fixed. The hemming or other fixing of the edges is indicated by the drawing. It is especially expedient, as may be seen by comparing FIG. 3 to FIG. 2, that the backing textile 1 shown here is a velour fabric, its rough side forming the mopping side 4 with a trimming 4*a*, which is active in cleaning.

In contrast, in the exemplary embodiment shown in FIGS. 4 to 6, the backing textile 1 is a knitted fabric, and not a woven fabric. The edges do not have to be hemmed for a knitted fabric. It may simply be cut off in the desired length as a web from a roll and does not require any hemming at the edges.

For the exemplary embodiment shown in FIGS. 1 to 3, it is particularly expedient for the backing textile 1 as a whole, or at least a trimming 4*a* of the backing textile 1, to be made of micro-fiber material, particularly polyester micro-fiber material. It is particularly advantageous, in this case, for the micro-fiber material to be synthetic and to predominantly have micro-fibers of approximately 0.5 to approximately 1.0 dtex. This also applies correspondingly for the exemplary embodiment of FIGS. 4 to 6, which is directed to an embodiment with knitted fabric.

The use of micro-fiber material made of thin micro-fibers is especially expedient if a velour fabric is implemented, because in this case the trimming 4*a* of the backing textile 1, forming the mopping side 4, which is active in cleaning, is formed by the open micro-fibers.

For a mop cover of this type in the preferred embodiment described above as a micro-fiber velour fabric, a dry weight of the mop cover of approximately 60 g, a wet weight of approximately 440 g, and therefore water absorption of approximately 380 g or approximately 660% results for a support of 40 cm length. This is to be compared with an equally large, classical loop/fringe mop cover having a dry weight of approximately 160 g, a wet weight of approximately 680 g, and water absorption of approximately 520 g or approximately 320%.

The polyester micro-fibers in the preferred exemplary embodiment of a mop cover have a high water absorption, which is made possible by the polarity of the atomic bonds. This polarity to oxygen/carbon is first sufficiently effective for polyester fibers when the micro-fibers are manufactured having approximately 1 dtex or less thickness (1 dtex=1 g/10,000 meters).

For optimum design of a mop cover according to the present invention, the following considerations are also significant:

Natural fibers (such as cotton fibers) and chemical fibers made of natural polymers (such as viscose fibers) are used as food by microorganisms. Mold spots arise, and the fibers are destroyed if there is moisture and warmth. The reason for this is that the number of carbon atoms in the molecule is even. Cotton fibers are natural micro-fibers in which the polarity of the large fiber surface causes a natural absorbency. Because of this, in spite of the problems described above, cotton fibers have been preferably used for mop covers of this type until now.

Chemical fibers made of synthetic polymers, particularly polyester fibers, are resistant to microorganisms. No mold spots arise and the fibers are not destroyed. This is because the number of carbon atoms in the molecule is not even. In addition, polyester fibers in particular are very smooth, so that pigmented dirt may be washed off significantly easier than is the case for cotton fibers.

In order to implement the polarity necessary for the absorbency, i.e., the water absorption, it is necessary to draw the polyester fibers sufficiently fine. It has been shown that sufficient absorbency is only implemented when an appropriate capillary effect of the polyester fibers is implemented. This requires a sufficient effect of thin polyester fibers. Simultaneously, the dirt absorbency of the polyester velour fabric increases with the finer fibers.

The particular advantage of a knitted fabric as a backing textile 1 for a mop cover according to the invention is that it is particularly suitable for use of micro-fibers in particular of polyester at least as a the trimming 4*a* on the mopping side 4 of the backing textile 1.

Although it is not displayed in the drawings in general, it is possible that an additional backing layer is positioned on the top side 7 of the backing textile 1 and fixedly attached thereto, and carries the attachment means 13 for the mop holder 5.

Figure 7:
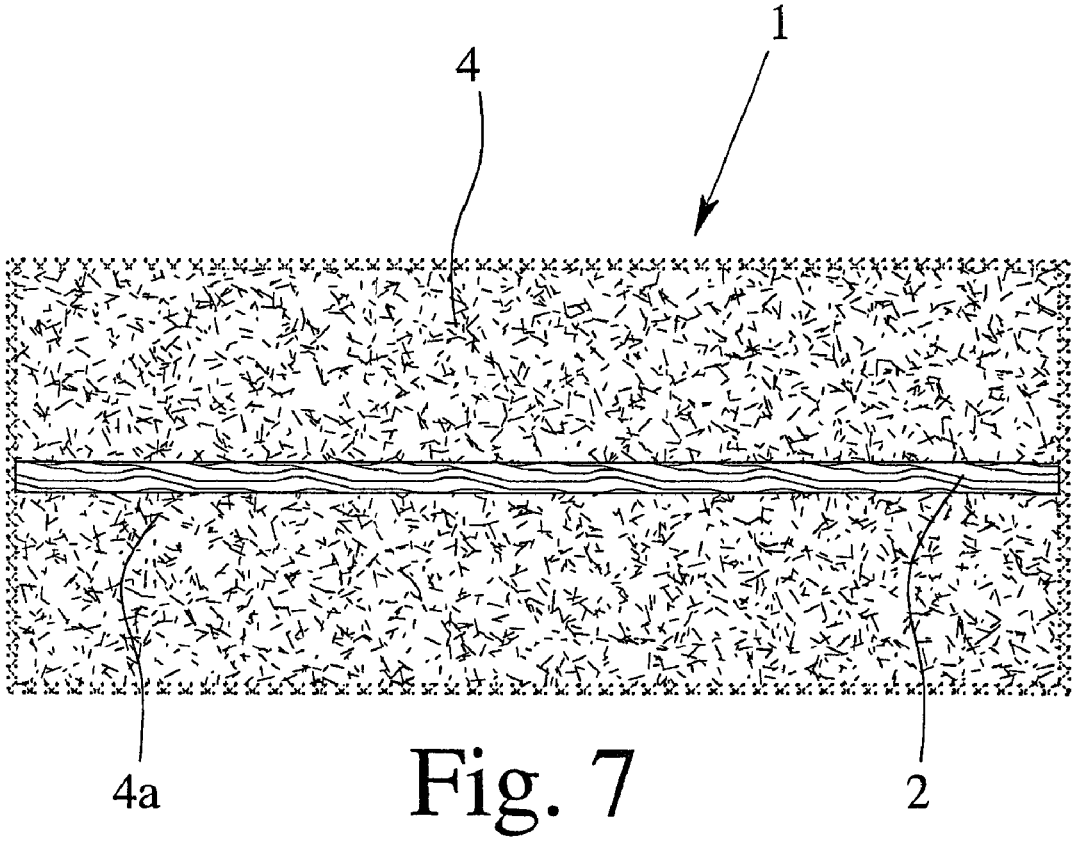
FIG. 7 shows a mop cover in a modified version, seen from the bottom.

Now, FIG. 7 shows a further embodiment of a mop cover according to the invention, now seen from the bottom side thereof. The particular design of this mop cover is that the backing textile 1 on its mopping side 4 is provided with at least one gliding assistance strip 2 running essentially parallel to the longitudinal edges of the mop cover, the gliding assistance strip 2 preferably being positioned approximately in the middle of the mopping side 4 and being made from an easily gliding textile material like polyester felt. Polyester felt allows easy gliding of the mopping side 4 of this mop cover in spite of the fact that gliding resistance of the other areas of polyester micro-fiber is high. In this specific embodiment, the gliding assistance strip 2 was tested with a thickness of 4 mm and a width of 20 mm.

The orientation of the gliding assistance strip 2 is important not for the gliding assistance effect, but for the optics of the surface that has been cleaned with such a mop cover. A different orientation would lead to an uneven cleaning optics on the floor.

Figure 8:
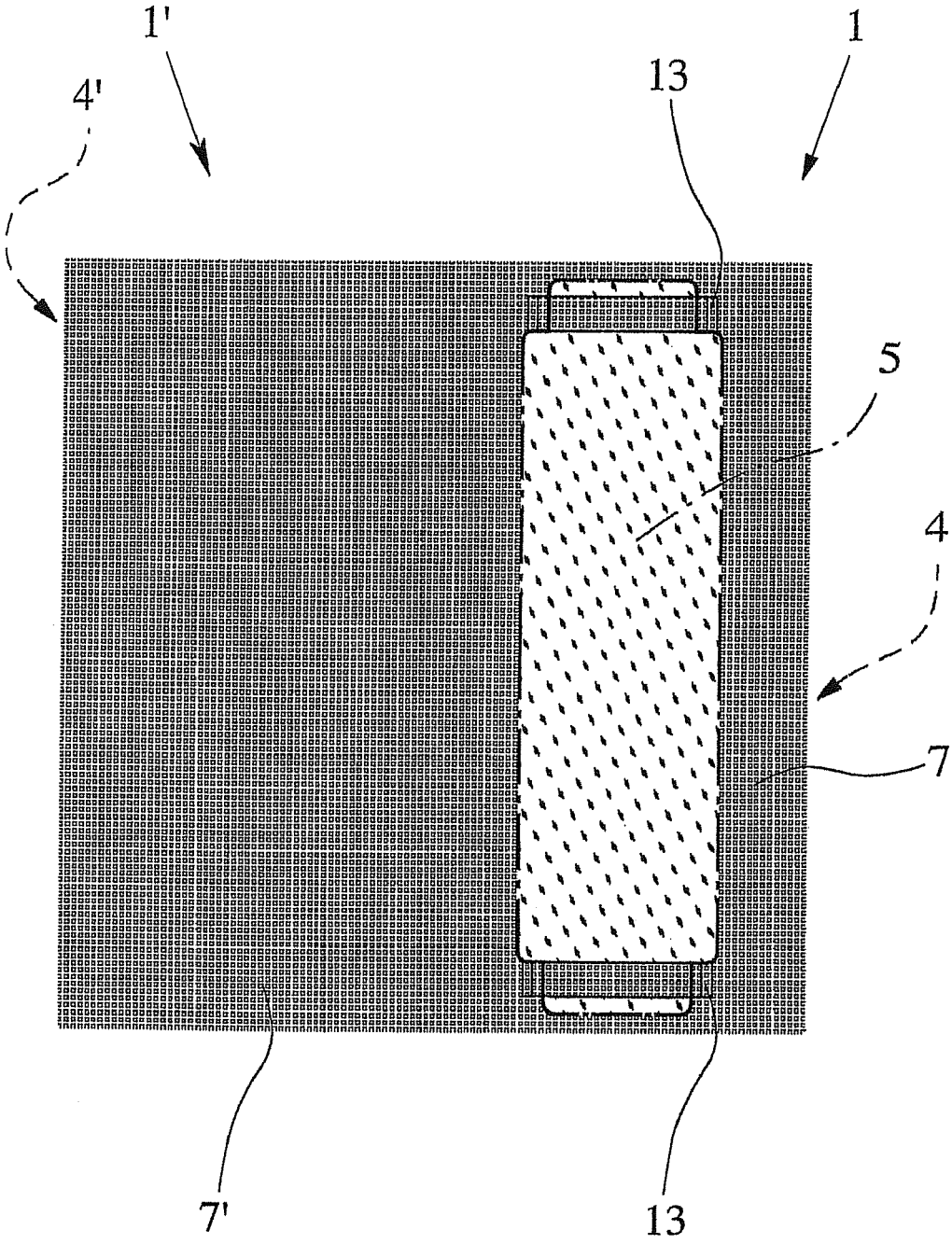
FIG. 8 shows a mop cover in a third embodiment, seen from the top.

FIG. 8 shows a further and preferred embodiment of the invention. Here, you may see a flat mop cover for a mopping device, comprising a large area backing textile 1 having longitudinal edges and transversal edges and having a mopping side 4, which is active in cleaning, and a top side 7, which is used to attach the mop cover to a mop holder 5 of a mopping device 6, wherein insertion pockets, holding strips or other attachment means 13 for the mop holder 5 are provided on the top side 7 of the backing textile 1. However, next to the first mop cover, a second flat mop cover with a backing textile 1' with a mopping side 4' and a top side 7', but without attachment means for a mop holder, is provided laterally next to the first flat mop cover at one of its longitudinal edges.

In the embodiment of FIG. 8, it is provided that the backing textiles 1; 1' of both mop covers are formed as a unitary, enlarged backing textile 1, 1'. Moreover, here, the flat mop cover as such is a unitary piece of material, so that the mopping sides 4, 4' are not separated from each other at all. However, the attachment area for the mop holder 5 is the area of the one flat mop cover, whereas the area of the other, second flat mop cover has no attachment means for the mop holder 5. So, the area of the first mop cover with the mop holder 5 on top may be put under pressure and, thus, can be used specifically for removing soil from the floor. The other part, with the second flat mop cover, follows with no vertical pressure, but is able to retain soil and cleaning liquid from the floor.

Figure 9:
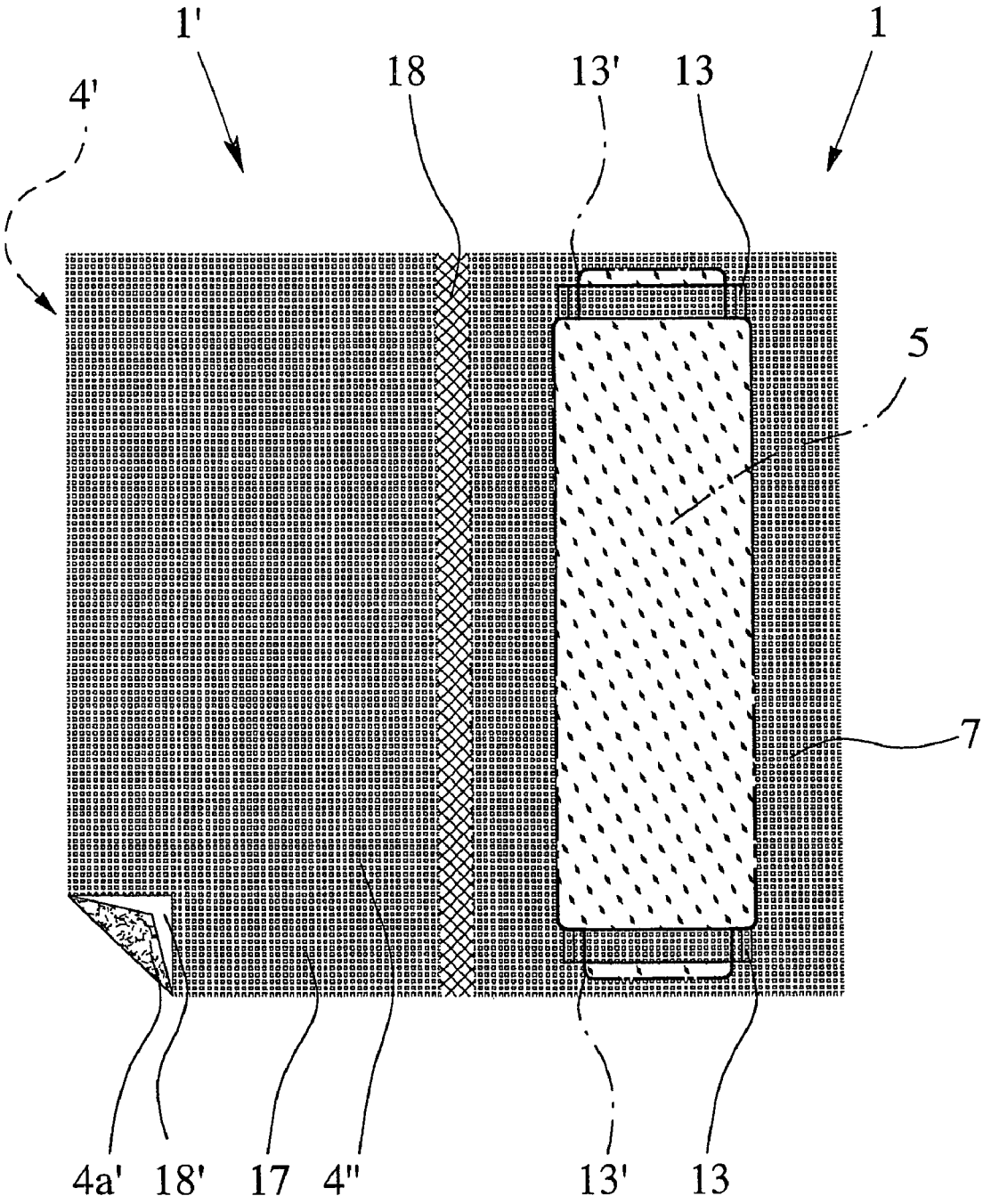
FIG. 9 shows a mop cover in a fourth embodiment, seen from the top.

A different embodiment that is implicitly shown in FIG. 9 of the drawings has an alternative construction of the mop cover, because the backing textiles 1, 1' of both mop covers are separate parts, but are fixedly connected to each other. This realizes a separating line between the two parts of the mop cover. This will be explained in detail later.

The embodiment of FIG. 8 further shows holding strips 13 as attachment means for the mop holder 5. In dashed lines on top of the first section within the attachment means 13 is indicated the contour of a corresponding mop holder 5, which shows position fixing means of the mop holder which correspond to the attachment means 13 as generally disclosed in WO 03/020100 A1 and already mentioned above.

FIG. 9 shows a further embodiment of the invention that has a further active layer 17 forming a third mopping side 4" positioned on the top side 7' of the backing textile 1' of the second mop cover. So, this is altogether a one-layer/two-layer combination with the attachment means 13 on the one-layer part and the two-layer part forming two alternately usable cleaning surfaces or mopping side 4', 4" of the same or of different properties.

In FIG. 9 it is indicated that the edges of the knitted fabric are not hemmed. In the embodiment of FIG. 9, it would be possible that the separating section 18 is of the same material as the backing textiles 1, 1' of the neighboring mop covers and is unitarily formed therewith. However, in the embodiment shown, it is so that the separating section 18 is a separate part, but connected to the neighboring backing textiles 1, 1' and is from a different material than the material of the neighboring backing textiles 1, 1'. It may be possible that the separating section 18 is made from a net-like material from preferably synthetic fibers. If the separating section 18 is of abrasive material, a soil-removing effect can be increased compared with traditional soil-retaining mopping sides.

Further, FIG. 9 has in the two-layer section a construction in that a separating section 18' is provided as a liquid-impermeable separating layer between the active layer 17 and the backing textile 1' of the second mop cover.

The complete mop cover according to the above-mentioned embodiments of the invention has a total size that is more than twice the size of an assigned mop holder 5. In general, traditional mop covers and mop holders for professional floor cleaning have a length of approximately 20 cm to approximately 100 cm, preferably of approximately 40 cm to approximately 60 cm. The width is preferably about 20 cm. So, in this embodiment, the width of the mop cover in total doubles to about 40 cm, although the standard mop holder 5 can be used.

Reference is made, here, in general to the co-pending PCT application mentioned above, PCT/EP2004/07014, giving its full supplemental disclosure.

A further and independent inventive idea lies in the option to form the attachment means 13 in the form of holding strips directly from the textile material of the backing textile 1 by placing cuts in the backing textile 1. By this, no separate attachment of the attachment means 13 to the backing textile 1 would be necessary. However, the backing textile 1 would have these cutouts at the position of the attachment means 13 on the mopping side.

The invention claimed is:

1. A mop cover for a mopping device, comprising:

a first backing textile having longitudinal edges and transversal edges and having a mopping side, which is active in cleaning, and a top side, which is used to attach the mop cover to a mop holder of a mopping device, wherein attachment means for a mop holder are provided on the top side of the first backing textile;

and a second backing textile laterally next to the first backing textile at one of the longitudinal edges of the first backing textile, said second backing textile having a mopping side and a top side free of attachment means for a mop holder, wherein the two mopping sides of the first and second backing textiles are hydraulically separated by a liquid-impermeable separating section.

2. A mop cover according to claim 1, wherein a further active layer forming a third mopping side is positioned on the top side of the second backing textile.

3. A mop cover according to claim 2, wherein a separating section is provided as a liquid-impermeable separating layer between the further active layer and the second backing textile.

4. A mop cover according to claim 1, wherein the separating section is a separating strip between the first and second backing textiles.

5. A mop cover according to claim 1, wherein the separating section is of the same material as the first and second backing textiles and is unitarily formed therewith.

6. A mop cover according to claim 1, wherein the separating section is a separate part, but connected to the first and second backing textiles and is from a different material than the material of the first and second backing textiles.

7. A mop cover according to claim 6, wherein the separating section is made from a net-like material.

8. A mop cover according to claim 1, wherein the separating section comprises an abrasive material.

9. A mop cover according to claim 1, wherein the first and second backing textiles are knitted fabric.

10. A mop cover according to claim 9, wherein the edges of the knitted fabric are unhemmed.

11. A mop cover according to claim 1, wherein the edges of the first and second backing textiles comprise trimming.

12. A mop cover according to claim 11, wherein the trimming is a loop-forming material.

13. A mop cover according to claim 1, wherein the first and second backing textiles are microfiber.

14. A mop cover according to claim 1, wherein the first and second backing textiles are polyester.

15. A mop cover according to claim 1, further comprising at least one gliding assistance strip located on the mopping side of either the first backing textile or the second backing textile.

16. A mop cover according to claim 15, wherein the gliding assistance strip is polyester felt.

17. A mop cover according to claim 1, wherein the first and second backing textiles are separate parts fixedly connected.

18. A mop cover according to claim 1, wherein the first and second backing textiles comprise a unitary enlarged backing textile.

* * * * *